United States Patent [19]

Fox et al.

[11] 3,934,809

[45] Jan. 27, 1976

[54] SLITTED FLEXIBLE MOLD

[75] Inventors: Robert H. Fox, Hoffman Estates; Robert J. Henning, Crystal Lake; Miroslav Psensky, Cary, all of Ill.

[73] Assignee: The Quaker Oats Company, Chicago, Ill.

[22] Filed: Dec. 4, 1974

[21] Appl. No.: 529,335

[52] U.S. Cl. ..... 249/117; 249/127; 264/313; 425/440; 425/DIG. 44

[51] Int. Cl.[2] ..... B28B 7/06; B28B 7/20

[58] Field of Search..... 425/803, DIG. 57, DIG. 58, 425/DIG. 44, 440, 441; 249/66 R, 66 A, 127, 183, 134, 179, 177; 264/313, 314, 315, 318, 334, 335, 336, DIG. 50, 219; 164/228

[56] References Cited

UNITED STATES PATENTS

| | | | |
|---|---|---|---|
| 1,551,603 | 9/1925 | Melosi | 249/178 |
| 2,196,258 | 4/1940 | Erdle | 264/313 X |
| 3,309,738 | 3/1967 | Friedman | 425/DIG. 57 |
| 3,353,220 | 11/1967 | Lenoble | 264/313 X |
| 3,776,683 | 12/1973 | Putzer | 425/DIG. 44 |

*Primary Examiner*—Francis S. Husar
*Assistant Examiner*—John S. Brown
*Attorney, Agent, or Firm*—Joseph P. O'Halloran

[57] ABSTRACT

A flexible distensible mold for use in fabricating art forms and utilitarian articles, and for use with the aid of air pressure differential enlargment of the shaping cavity, is provided with closeable slits extending from at least portions of the shaping cavity partly into the mold wall. With these improved molds the withdrawal-bore of the shaping cavity can be greatly enlarged, and the side walls can be greatly extended with lower air pressure differentials than would be otherwise necessary.

3 Claims, 12 Drawing Figures

FIG. 1
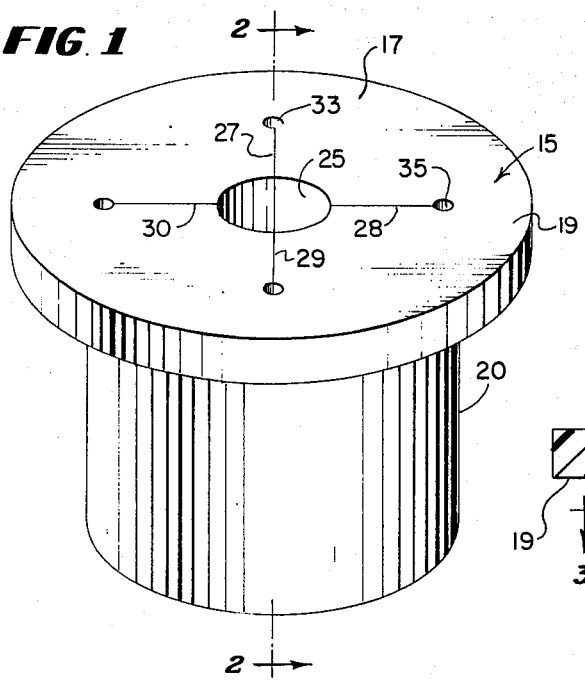
FIG. 2
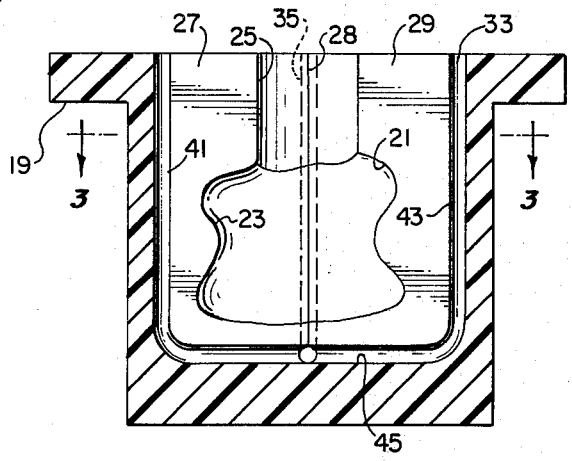
FIG. 3
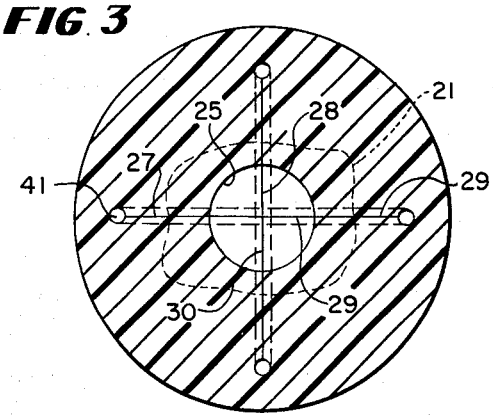
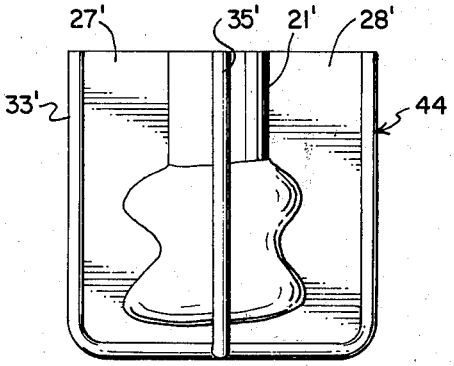
FIG. 4
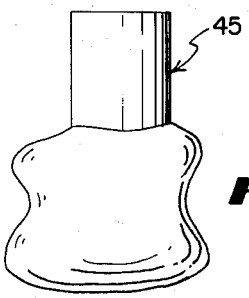
FIG. 5

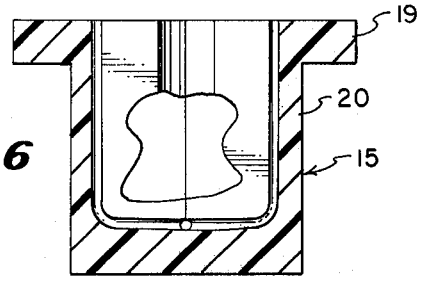
FIG. 6
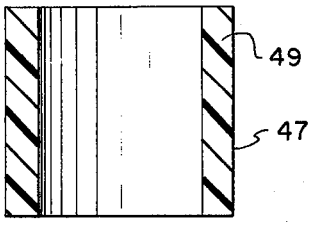
FIG. 7
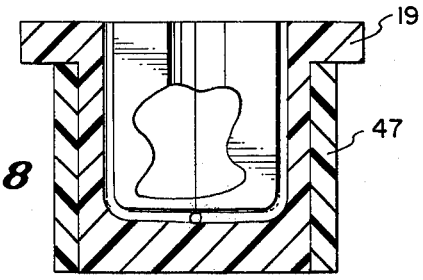
FIG. 8
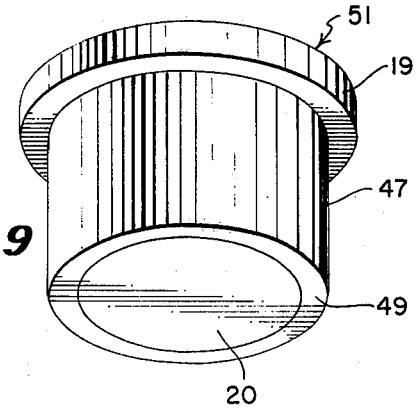
FIG. 9
FIG. 10
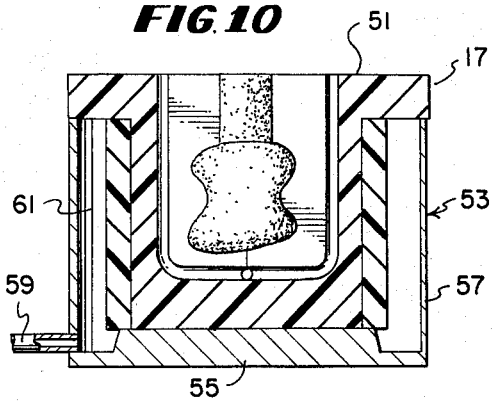
FIG. 11
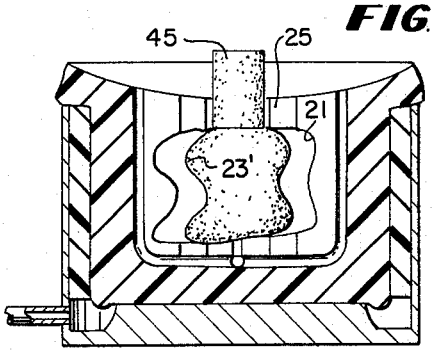
FIG. 12
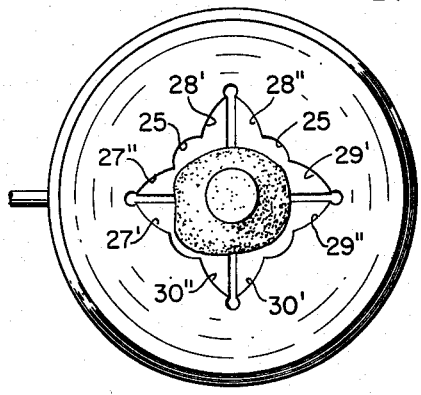

SLITTED FLEXIBLE MOLD

Flexible distensible molds can be used to shape art forms as well as utilitarian materials such as hardenable foundry sand mixes for the production of cores and molds. After a hardenable mixture is placed in the shaping cavity and hardens at least to some extent, the shaping cavity of flexible distensible molds can be enlarged by air pressure differential to such an extent that the shaped article with undercut regions can be withdrawn from the flexible mold.

Patents relating to such molds include U.S. Pat. No. 2,124,871, C. L. Beal and U.S. Pat. No. 3,776,663 to Putzer.

Continued development in connection with the use of flexible distensible molds, such as, for example in the production of foundry cores, has uncovered several serious problems. For example, it has been found to be difficult to faithfully reproduce the dimensions of a pattern when flexible distensible material is used to make the mold, because the weight of the material being shaped such as, for example, hardenable sand mixes, causes so much distension of the stretchable mold material that the "distension" becomes appreciable distortion. In many foundry applications, for example, the standards for performance are so strict that the core's dimensions must be true within 1/32 inch of the pattern or less.

One approach taken to stabilize the dimensions of the cavity during filling with foundry sand results in molds made from flexible distensible material having relatively thick walls. This, in turn, has led to other problems, particularly in connection with removing the resulting shaped articles from the mold by air pressure differential. Many articles have a body portion which is of substantially greater radius or diameter than that portion of the article which is formed in the neck or filling channel of the mold. These articles are often extremely difficult to withdraw through the relatively small diameter bore of the neck of the mold even after the air pressure differential is applied. Inasmuch as the presently contemplated mode for increasing the size of the cavity relies on the forces generated by an air pressure differential between the exterior and interior surface of the mold, the vacuum method soon becomes an unattractive method for opening or enlarging mold cavities in molds which require very thick walls to stabilize the dimensions of the cavity, if one were to rely only on prior technology.

In accordance with the present invention the flexible distensible elastomeric molds are provided with closed, openable slits extending radially outwardly from at least portions of the shaping cavity only partly through the mold wall. Planar slits are preferred. Thus, provision of slits in accordance with this invention keeps the walls of the mold impermeable to the passage of air therefrom, and allows the molds to be used, as described hereinafter in conjunction with vacuum pots and other air pressure differential means for cavity enlargement for easy removal of shaped articles therefrom. Thus, molds constructed in accordance with this invention have been found to allow for relatively easy extraction of patterns and hardened shaped articles, such as shaped foundry sand articles, from the mold cavity. This is particularly true in connection with those molds requiring relatively great enlargement of the exit from the shaping cavity and in which the wall thicknesses are relatively great. These slits provide a hinging action, because the slits which are "closed" when the material is "at rest", open wide during the application of pressure differential to provide mold cavity enlargement far beyond that which can be achieved in connection with mere stretching of the walls by distending the relatively thick flexible wall cavity at any given pressure differential.

The invention and particularly preferred embodiments thereof are described hereinafter with the aid of the accompanying drawings in which:

FIG. 1: is a perspective view of a mold in accordance with the present invention.

FIG. 2: is a horizontal elevational cross sectional view taken approximately along the line 2—2 in FIG. 1.

FIG. 3: is a cross sectional view taken approximately along the line 3—3 of FIG. 2.

FIG. 4: is an elevational side view of a pattern for use in producing molds in accordance with the present invention.

FIG. 5: is a side view of the article shaped in accordance with the use of the molds of the present invention made with the pattern shown in FIG. 4.

FIG. 6: is a reduced scale cross sectional elevational view of a mold in accordance with the present invention similar to the mold shown in FIG. 2.

FIG. 7: is a cross sectional elevational view of a cylindrical sleeve made of flexible distensible elastomeric material.

FIG. 8: is a view taken along the same cross sectional lines as that used in FIGS. 6 and 7 except that the cylinder of FIG. 7 is shown in assembled position around the mold of FIG. 6.

FIG. 9: is a perspective view of the composite structure assembled as shown in FIG. 8.

FIG. 10: is a cross sectional view of a mold-vacuum box assembly utilizing the mold shown in FIG. 9.

FIG. 11: is a diagramatic illustration using a view along a vertical mid-sectional plane, as in FIG. 9, showing the relative position of elements of the assembled mold as shown in FIG. 10 after vacuum is applied.

FIG. 12: is a top view of the mold in condition shown in FIG. 11.

In the accompanying drawings a flexible distensible mold in accordance with the present invention is generally indicated by the numeral 15. Mold 15 is made of flexible distensible elastomeric material, and is of integral construction. Much literature and numerous patents describe the manufacture of flexible molds from elastomeric material, and the particular materials used does not constitute part of the invention and is not discussed herein for that reason. Mold 15 includes a top portion 17 including a radially extending flange portion 19. A shaping cavity 21 includes a relatively wide body portion 23 and a relatively narrow neck portion 25 which extends upwardly through top 17. Mold 15 also includes a plurality of slits 27, 28, 29 and 30 which extend between shaping cavity 21 and enlarged respective marginal channels 33, 35. Respective walls 27′, 27″, 28′, 28″, 29′, 29″ and 30′, 30″ of slits 27, 28, 29 and 30 abutt against one another when the mold is "at rest" as shown in FIG. 1. It is noted that the cross sectional line 2-2 in FIG. 1 extends through slits 27, 29 which extend to marginal channel 33 and that respective slits 28, 30 extend to marginal channel 35. It will be apparent from consideration of FIG. 2 that the marginal channels 33, 35 extend downwardly through vertical legs 41, 43 and transversely through horizontal portion 45. Channel 35 is similarly constructed. Thus the slits 27, 28, 29 and 30 generally extend radially outwardly from the shaping cavity 21 to the vertical legs, e.g. 41, 43 of channels 33, 35 and generally axially downwardly from the cavity 21 to the horizontal portions e.g. 45 of channels 33, 35. The portions of slits 27, 28, 29 and 30 which extend from the bottom of cavity 21 can be viewed in FIG. 3 through shaping cavity opening 25.

It is noted that when the mold is in its "at rest" configuration, slits 27, 28, 29 and 30 are "closed". That is, the walls thereof abut each other and the hardenable material being shaped does not enter slits 27, 28, 29 and 30.

A pattern for use in the fabrication of the mold in accordance with the present invention is illustrated in FIG. 4 and is generally indicated by the numeral 44. The pattern 44 includes a body portion 21' which corresponds in shape to the shaping cavity 21. Pattern 44 also includes radially outwardly extending fins, for example, 27''' and 29''' corresponding to slits 27, 28, 29 and 30, the fins extending radially outwardly and axially downwardly to connect with marginally enlarged portions for example 33', 35', corresponding negatively to the shape of channels 33, and 35. The pattern 44 is used to shape the cavity position 21 of mold 15 illustrated in FIG. 1 in well known and customary manner by emersing the pattern 44 in a hardenable polymerizable elastomeric material which hardens to provide the pattern 44 embedded in the mold material. Upon removal of pattern 44 from the mold material, mold 15 results. When shaping cavity 21 is then filled with a hardenable mixture such as, for example, a hardenable foundry sand mixture, a shaped foundry article such as core 45 which is illustrated in FIG. 5 results.

A particularly preferred aspect of the present invention is illustrated with the aid of FIGS. 6 through 9 and the use of molds in accordance with the present invention to produce shaped articles as illustrated with the aid of FIGS. 9 through 12.

FIGS. 6–9 are arranged in vertical positioning with respect to one another to illustrate the relative size and shape of components used to produce the particularly preferred composite mold 51 in accordance with the present invention. In FIG. 6 a mold 15 having main body portion 20 and flange 19 is shown in reduced scale and the mold 15 is substantially identical to the mold 15 as shown in FIG. 1 and discussed hereinbefore.

Immediately below FIG. 6 is illustrated a sleeve 47 having a relatively thick wall portion 49. The purpose of orienting FIG. 7 immediately below FIG. 6 is to illustrate the relative dimensions of these articles. It is noted that the outside diameter of sleeve 47 is substantially equal to the outside diameter of body portion 20 and the inside diameter of sleeve 47 is substantially smaller than the outside diameter of body portion 20 shown in FIG. 6. In accordance with a preferred aspect of the present invention, the sleeve 47 is stretched and body portion 20 is inserted within wall 49 as shown in FIG. 8 so that one end of sleeve 47 butts against flange portion 19 and the other end of sleeve 47 is approximately co-extensive with the bottom of body portion 20 without axially stretching sleeve 47. This is illustrated in FIGS. 8 and 9.

In the embodiment in the assembled condition shown in FIGS. 6 and 9, the mold in accordance with the present invention constitutes a composite flexible mold comprising an internal integral flexible stretchable shaping element mold 15 by which internal element 20 confines the hardenable or otherwise curable material being molded, and a second outer element 47 which is a flexible stretchable element, distinct and separate from the first element the outer element being in direct and closely confining contact with the inner element, the outer element now being in a condition of stress due to stretching thereof along its circumference. No axial stretch is used in this embodiment. However, sleeve 47 can be stretched axially if desired to further stabilize the dimensions of the cavity during filling. Nonetheless the use of the outer element 47 is optional and the sequence of steps discussed immediately hereinafter in connection with FIGS. 10–12 showing the use of the mold 20, is identical whether or not optional sleeve 47 is utilized. Hence, the following discussion refers to the use of either mold assembly 51, and to mold 15.

In FIGS. 10–12 the use of the mold 15 (or 51) in accordance with the present invention shown with mold 51 illustrated diagramatically in place in a vacuum pot generally indicated by the numeral 53. Vacuum pot 53 includes a bottom 55 which is slightly elevated and upon which the bottom of mold 51 (15) resides, and pot 53 also includes side walls 57 which extend upwardly to abutt against and sealingly engage radially extending flange portion 17 at the bottom thereof. Vacuum conduit 59 passes through sidewall 57 and into the annular air space 61 constituting the gap between the mold 51 and the pot 53. When a vacuum is applied to air space 61, as a consequence of the withdrawal of air from air space 61 through conduit 59, the relatively higher ambient atmospheric air pressure within the mold cavity 21, and the pressure of the air within channels 33, 35 causes the mold 51 (15), and particularly the shaping cavity 21, to enlarge until the mold reaches the configuration shown in FIG. 11. It is noted neck portion 25 as shown in FIG. 11 has enlarged to the extent that the relatively wide body portion 23' of sand shape 45 can now be lifted axially upwardly and removed from shaping cavity 21. In FIG. 12 it is also apparent that walls 27', 28', 29' and 30' of slits 27, 28, 29 and 30 have been moved substantially apart from one another in a hinging action wherein the flexible material of mold 15 acts as a hinge, to assist in the enlargement of the withdrawal bore defined by the now greatly separated segments of neck portion 25 and open walls 27', 28', 29', and 30'.

The marginal portions 33, 35 of the slits are optional and are found to greatly extend the life of the mold by arresting a tendency of slit propagation through the mold walls.

The illustrated embodiments have been shown for illustrative purposes only and it is to be understood that, given the disclosure herein, many variations and combinations can be made without departing from the spirit and scope of the present invention. For example, an embodiment using 4 slits is illustrated, but one or more slits can be utilized. Also, for example, the use of stressed composite confining element 47 is optional and the use of the enlarged marginal channels 33, 35 at the radial and axial extremes of the slits are optional. Channels 33, 35 can be rounded ends of the slits 27, 28, 29, 30, or they can be eliminated entirely. Also, in accordance with the present invention, it is not necessary that the slits 27, 28, 29, 30 extend around the entire periphery of the enlarged body portion 20 but, instead can extend radially from portions of the shaping cavity 21. Thus, for example, slits 27, 28, 29 and 30 could extend from the neck portion 25 radially to a distance approximately at the radial extent of the enlarged body portion of cavity 21.

In an alternative embodiment, the slit can extend from the enlarged body portions or from backdrafts within the body portion and can extend in directions other than in the illustrated axial or radial directions.

It is noted that the thickness of the wall of the mold is substantially reduced at the radial extreme of the slits and it is also noted that with the cavity-expanding movement and extension of the flexible distensible elastomeric mold under air pressure differential, the respective walls of the slits separate from one another thus defining a portion of the enlarged withdrawal bore.

We claim:

1. In an integral flexible distensible mold having wall portion defining a shaping cavity therein, the improvement comprising: a closed openable slit in said wall portion, said slit extending from at least a portion of the wall of the shaping cavity and only partly through the wall portion of the mold, the slit including an enlarged marginal portion thereof at the outward extreme thereof.

2. A flexible distensible mold having walls defining a shaping cavity, said mold having extending radially outwardly into said wall from said shaping cavity a closed, openable slit which extends from the top to the bottom of said cavity, and in which slit extends only partly through the wall of the mold, the slit including an enlarged marginal portion thereof at the outer extreme thereof.

3. A flexible distensible mold having a radially extending flange portion at the top thereof, and having a body portion depending from said flange portion, and a shaping cavity extending through the top portion and into the body portion, said mold having a closed openable slit through at least a portion of the mold, said slit extending from at least a portion of the shaping cavity and only part way through the mold, the slit terminating at its outward extreme with an enlarged portion thereof.

* * * * *